US006700504B1

(12) United States Patent
Aslandogan et al.

(10) Patent No.: US 6,700,504 B1
(45) Date of Patent: Mar. 2, 2004

(54) METHOD AND SYSTEM FOR SAFE EMERGENCY VEHICLE OPERATION USING ROUTE CALCULATION

(75) Inventors: Yuksel Alp Aslandogan, Arlington Hts, IL (US); Jerry Feigen, Chicago, IL (US)

(73) Assignee: Navigation Technologies Corp., Chicago, IL (US)

( * ) Notice: Subject to any disclaimer, the term of this patent is extended or adjusted under 35 U.S.C. 154(b) by 0 days.

(21) Appl. No.: 09/703,786

(22) Filed: Nov. 1, 2000

(51) Int. Cl.[7] ..... G08G 1/00

(52) U.S. Cl. ..... 340/901; 340/905; 340/988; 340/995; 701/201; 701/209; 701/213

(58) Field of Search ..... 340/901, 902, 340/905, 906, 909, 988, 990, 995; 701/23, 25, 26, 200, 201, 207, 208, 209, 213, 216, 117, 300, 301, 302

(56) References Cited

U.S. PATENT DOCUMENTS

| | | | | | |
|---|---|---|---|---|---|
| 5,014,052 | A | * | 5/1991 | Obeck | 340/906 |
| 5,307,060 | A | * | 4/1994 | Prevulsky et al. | 340/902 |
| 5,334,974 | A | | 8/1994 | Simms et al. | 340/990 |
| 5,345,232 | A | * | 9/1994 | Robertson | 340/906 |
| 5,495,243 | A | * | 2/1996 | McKenna | 340/902 |
| 5,539,398 | A | | 7/1996 | Hall et al. | 340/907 |
| 5,572,201 | A | * | 11/1996 | Graham et al. | 340/902 |
| 5,745,865 | A | * | 4/1998 | Rostoker et al. | 701/117 |
| 5,758,313 | A | | 5/1998 | Shah et al. | 701/208 |
| 5,835,907 | A | | 11/1998 | Newman | 707/10 |
| 5,889,475 | A | | 3/1999 | Klosinski et al. | 340/902 |
| 5,890,092 | A | | 3/1999 | Kato et al. | 701/216 |
| 5,902,341 | A | | 5/1999 | Wilson | 701/19 |
| 5,926,113 | A | | 7/1999 | Jones et al. | 340/906 |
| 5,933,093 | A | * | 8/1999 | Austin, II | 340/902 |
| 5,933,100 | A | | 8/1999 | Golding | 340/995 |
| 5,952,959 | A | | 9/1999 | Norris | 342/357 |
| 5,955,968 | A | | 9/1999 | Bentrott et al. | 340/906 |
| 5,986,575 | A | | 11/1999 | Jones et al. | 340/906 |
| 6,011,492 | A | * | 1/2000 | Garesche | 340/904 |
| 6,064,319 | A | | 5/2000 | Matta | 340/917 |
| 6,087,961 | A | | 7/2000 | Markow | 340/902 |
| 6,094,148 | A | * | 7/2000 | Henry et al. | 340/902 |
| 6,107,961 | A | | 8/2000 | Takagi | 342/357.13 |
| 6,133,854 | A | * | 10/2000 | Yee et al. | 340/907 |
| 6,144,318 | A | * | 11/2000 | Hayashi et al. | 340/995 |
| 6,160,493 | A | | 12/2000 | Smith | 340/902 |
| 6,226,589 | B1 | | 5/2001 | Maeda et al. | 701/207 |
| 6,236,336 | B1 | * | 5/2001 | Oliva et al. | 340/901 |
| 6,241,197 | B1 | | 6/2001 | Harland | 246/293 |
| 6,243,026 | B1 | * | 6/2001 | Jones et al. | 340/906 |

* cited by examiner

*Primary Examiner*—Toan Pham
(74) *Attorney, Agent, or Firm*—Jon D. Shutter; Frank J. Kozak; Lawrence M. Kaplan

(57) ABSTRACT

A system and method are disclosed that make operation of an emergency vehicle safer. When an emergency vehicle is traveling to or from an emergency, a route for the emergency vehicle to travel is calculated using a navigation system. Traffic signals along the calculated route are controlled to give the emergency vehicle the right-of-way along the calculated route. In addition, data indicating the calculated route of the emergency vehicle are transmitted to other vehicles located along the calculated route. In each of these other vehicles, warnings are provided to the vehicle drivers. These warnings indicate the presence of the emergency vehicle and optionally, the expected path of travel of the emergency vehicle.

21 Claims, 7 Drawing Sheets

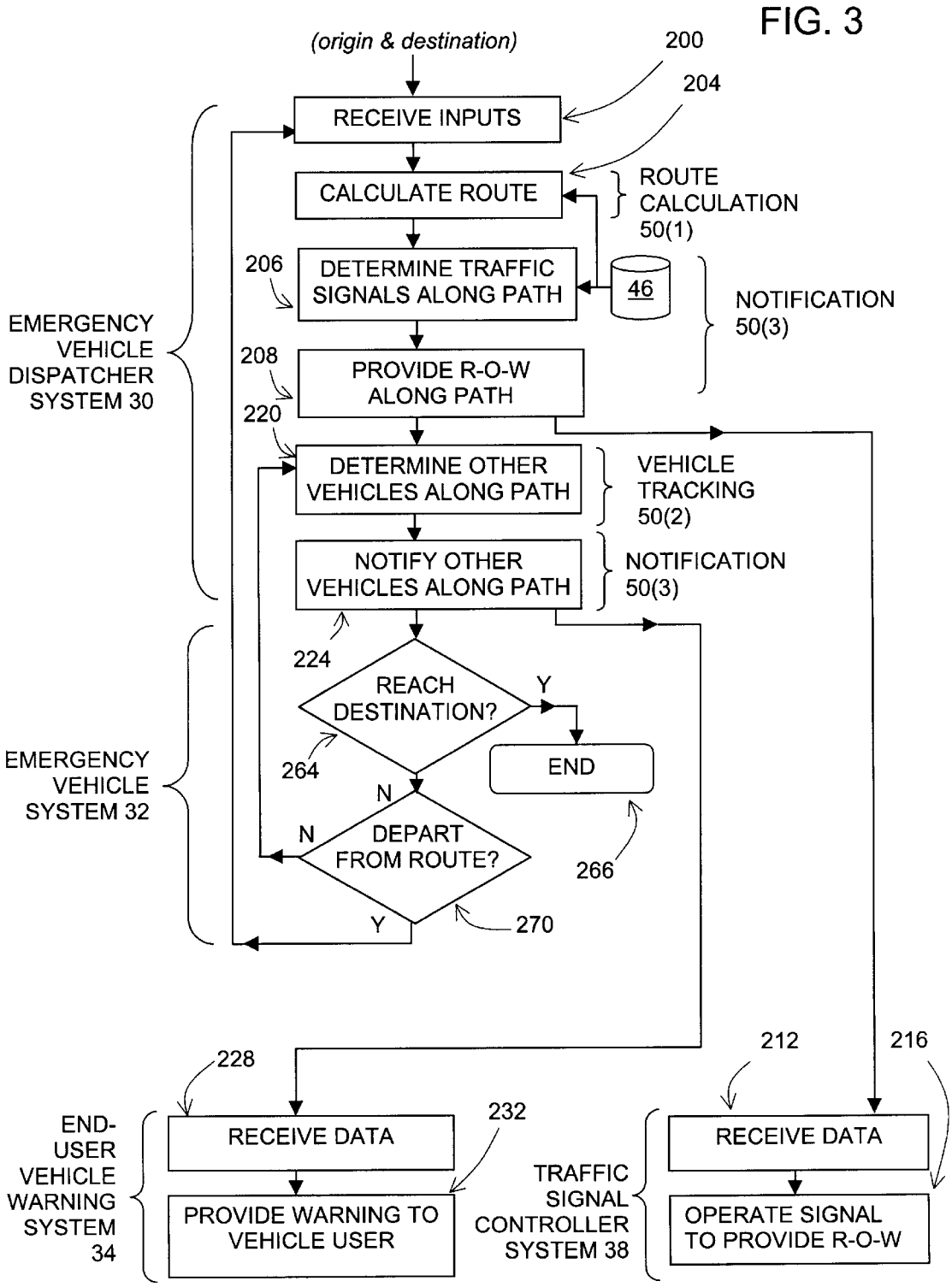
FIG. 3
(origin & destination)
200
204
RECEIVE INPUTS
CALCULATE ROUTE
ROUTE CALCULATION 50(1)
206
DETERMINE TRAFFIC SIGNALS ALONG PATH
46
NOTIFICATION 50(3)
EMERGENCY VEHICLE DISPATCHER SYSTEM 30
208
PROVIDE R-O-W ALONG PATH
220
DETERMINE OTHER VEHICLES ALONG PATH
VEHICLE TRACKING 50(2)
NOTIFY OTHER VEHICLES ALONG PATH
NOTIFICATION 50(3)
224
REACH DESTINATION?
Y
END
264
N
EMERGENCY VEHICLE SYSTEM 32
N
DEPART FROM ROUTE?
266
Y
270
228
212
216
END-USER VEHICLE WARNING SYSTEM 34
RECEIVE DATA
232
PROVIDE WARNING TO VEHICLE USER
TRAFFIC SIGNAL CONTROLLER SYSTEM 38
RECEIVE DATA
OPERATE SIGNAL TO PROVIDE R-O-W

METHOD AND SYSTEM FOR SAFE EMERGENCY VEHICLE OPERATION USING ROUTE CALCULATION

BACKGROUND OF THE INVENTION

The present invention relates to emergency vehicles, such as ambulances, fire engines, police cars, and so on, and more particularly the present invention relates to a system that helps make the operation of emergency vehicles safer.

Emergency vehicles, such as ambulances, fire engines, police cars, and so on, can pose hazards to other vehicles on the roads. While traveling to and from scenes of emergencies, emergency vehicles have been involved in accidents with other vehicles or have caused other vehicles to have accidents. There have been prior attempts to make the operation of emergency vehicles while traveling to and from scenes of emergencies safer. For example, U.S. Pat. No. 5,539,398 describes a system wherein an emergency vehicle is equipped with a GPS receiver. Equipment in the emergency vehicle uses the GPS receiver to determine the emergency vehicle's location and heading. Data indicating the emergency vehicle's location and heading are transmitted from the emergency vehicle to intersection controllers that are located at each intersection that has traffic signals. The intersection controller uses the data indicating the emergency vehicle position and heading to determine whether the emergency vehicle is on any road that might lead to the intersection. If the emergency vehicle is on any road heading toward an intersection, the intersection controller operates the traffic signals at the intersection to give the emergency vehicle the right-of-way.

Although the system described in U.S. Pat. No. 5,539 may address some safety issues concerning the operation of emergency vehicles, there is still room for improvement. For example, there is a need to predict the path of an emergency vehicle better so that safety measures may be implemented along the path.

SUMMARY OF THE INVENTION

To address these and other objectives, the present invention comprises a system and method that help make operation of emergency vehicles safer. When an emergency vehicle is traveling to or from an emergency, a route for the emergency vehicle to travel is calculated using a navigation system. Traffic signals along the calculated route are controlled to give the emergency vehicle the right-of-way along the calculated route. In addition, data indicating the calculated route of the emergency vehicle are transmitted to other vehicles located along the calculated route. In each of these other vehicles, warnings are provided to the vehicle drivers. These warnings indicate the presence of the emergency vehicle and optionally the expected path of travel of the emergency vehicle.

According to one aspect of the invention, a route for the emergency vehicle is calculated at a central location. Data representing the route are sent from the central location to the emergency vehicle where driving instructions are provided to the emergency vehicle driver for following the route. Data are also sent from the central location to the other vehicles along the route so that warnings can be provided to drivers of these other vehicles. The central database location also sends data to traffic signal controllers to provide the emergency vehicle with the right-of-way along the calculated route.

According to an alternative aspect of the invention, a route for the emergency vehicle is calculated using a navigation system in the emergency vehicle. The navigation system in the emergency vehicle provides driving instructions to the emergency vehicle driver for following the route. Data are also sent from the navigation system in the emergency vehicle to other vehicles within proximity to the emergency vehicle so that warnings can be provided to drivers of these other vehicles. The navigation system in the emergency vehicle also sends data to traffic signal controllers to provide the emergency vehicle with the right-of-way along the calculated route.

According to another aspect of the invention, data representing the traveling status (e.g., current location, heading, speed, acceleration, turn signal status, and optionally the route) of the emergency vehicle and the other vehicles located around the emergency vehicle are shared so that each vehicle (including the emergency vehicle) is informed of the traveling status of the vehicles around it. Using this information, vehicle paths and trajectories are predicted in order to identify the probability of potential accident occurrences. Warnings are provided, as appropriate, to avoid occurrences of accidents.

BRIEF DESCRIPTION OF THE DRAWINGS

FIG. 3 is a flow chart showing steps performed by the emergency vehicle warning system in FIG. 2.

DETAILED DESCRIPTION OF THE PRESENTLY PREFERRED EMBODIMENTS

I. FIRST EMBODIMENT

A. Overview

A first embodiment of an emergency vehicle safety system is described with reference to FIGS. 1–5. According to this embodiment, a route for the emergency vehicle is calculated at a central location and data representing the route are sent from the central location to the emergency vehicle.

Figure 1:
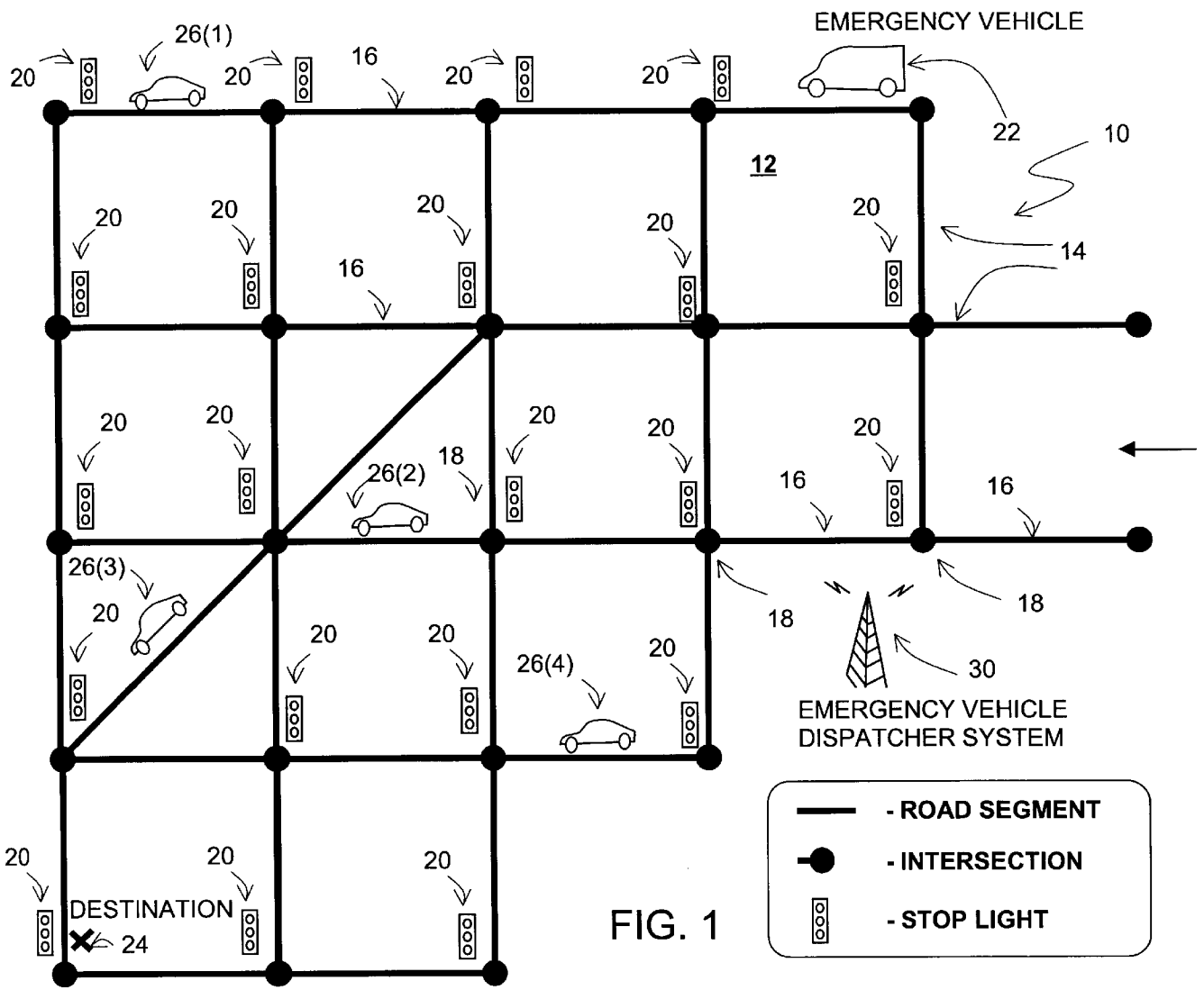
FIG. 1 is an illustration that shows an emergency vehicle and other vehicles located on a road network in a geographic area.

FIG. 1 shows a portion 10 of a geographic area 12. Located in the geographic area 12 is a road network 14. The road network 14 is comprised of roads and intersections. In FIG. 1, a road segment 16 forms that portion of a road between intersections 18 with other roads.

Traffic control signals 20 (e.g., stop lights) are associated with some of the intersections 18 in FIG. 1.

Located on the road network 14 in FIG. 1 is an emergency vehicle 22. The emergency vehicle 22 is an ambulance, although alternatively, the emergency vehicle could be a police car, a fire engine, a tow truck, or any other type of emergency vehicle. The emergency vehicle 22 is traveling toward a destination 24, which is located along one of the road segments 16 in the geographic area 12.

Also located on the road network 14 are other vehicles 26(1), 26(2) . . . . The other vehicles 26 include privately owned vehicles, but may also include commercial vehicles (e.g., trucks), publicly owned vehicles (e.g., busses), or even other emergency vehicles, including other emergency vehicles heading toward the same emergency.

Figure 2:
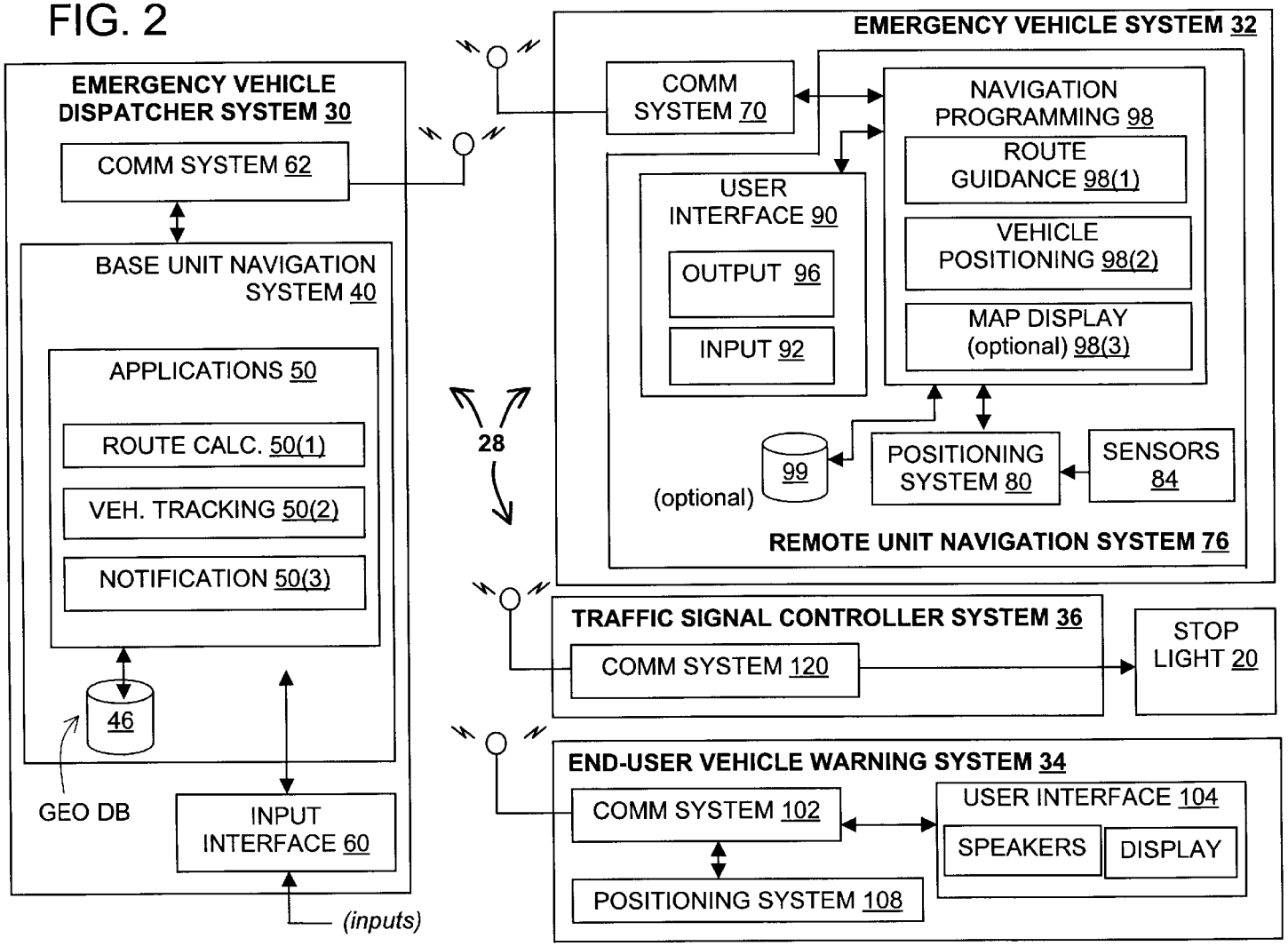
FIG. 2 is a block diagram showing components of an emergency vehicle warning system including an emergency vehicle dispatcher system, an emergency vehicle system, a traffic signal controller system, and an end-user vehicle warning system.

The geographic area 12 is served by an emergency vehicle safety system. FIG. 2 shows components of a first embodiment of the emergency vehicle safety system 28. The emergency vehicle safety system 28 in FIG. 2 includes four component sub-systems. These component sub-systems include an emergency vehicle dispatcher system 30, an emergency vehicle system 32, an end-user vehicle warning system 34, and a traffic signal controller system 36.

B. The Emergency Vehicle Dispatcher System

Referring first to the emergency vehicle dispatcher system 30, the emergency vehicle dispatcher system 30 includes a base unit navigation system 40. The base unit navigation system 40 is a combination of hardware and software components. The hardware components in the base unit navigation system 40 may include one or more processors, memory, data storage, a user interface, and so on.

The base unit navigation system 40 uses geographic data. The geographic data used by the base unit navigation system 40 may be organized into one or more geographic databases 46. The data in the geographic database 46 include information about the geographic area (12 in FIG. 1), and in particular, the geographic database 46 includes data about the roads and intersections that form the road network (14 in FIG. 1) located in the geographic area 12. The kinds of data about roads and intersections include the locations of the roads and intersections, the speed limits (or ranges), address ranges, locations of traffic signals, number of lanes, lane width, names of roads, functional classes of roads, turn restrictions at intersections, and so on.

The software components of the base unit navigation system 40 include one or more applications 50. In the embodiment of FIG. 2, the applications 50 include a route calculation application 50(1), a vehicle tracking application 50(2) and a notification application 50(3). The emergency vehicle dispatcher system 30 may also include other applications. In one embodiment, the navigation applications 50 are written in the C programming language although in alternative embodiments other programming languages may be used, such as C++, Java, Visual Basic, and so on.

The route calculation application 50(1) determines a route for the emergency vehicle 22 to travel along the road network (14 in FIG. 1) to reach a desired destination. In order to calculate a route, the route calculation application 50(1) is provided with data identifying a starting location (origin) and a desired destination location. In this embodiment, the destination location may be the scene of the emergency and the starting location may be the location from which the emergency vehicle 22 starts its trip to the scene of the emergency. Alternatively, the destination location may be an emergency treatment facility, e.g., a hospital, and the starting location may be the location from which the emergency vehicle 22 starts its trip to the treatment facility, e.g., the scene of the emergency. The data used to identify these locations may include the geographic coordinates of these locations, the street addresses of these locations, the names of these locations (e.g., General Hospital) or specification of the data entities in the geographic database 46 that represent the road segments upon which these locations are located.

Given at least the identification of a starting location (origin) and a desired destination location, the route calculation application 50(1) determines one or more solution routes between the starting location and the destination location. A solution route is formed of a series of connected road segments over which the emergency vehicle can travel from the starting location to the destination location. When the route calculation application 50(1) calculates a route, it accesses the geographic database 46 and obtains data that represent road segments around and between the starting location and the destination location. The road calculation application 50(1) uses the data to determine at least one valid solution route from the starting location to the destination location. The route calculation application 50(1) may attempt to find a solution route that takes the least time to travel.

The route calculation application 50(1) may use various means or algorithms in determining solution routes. Methods for route calculation are disclosed in Ser. No. 09/047,698, filed Mar. 25, 1998, the entire disclosure of which is incorporated by reference herein. (The methods disclosed in the aforementioned patent application represent only some of the ways that routes can be calculated and the subject matter claimed herein is not limited to any particular method of route calculation. Any suitable route calculation method now known or developed in the future may be employed.)

The route calculation application 50(1) provides an output in the form of an ordered list identifying a plurality of road segments that form the continuous navigable route between the origin and the destination.

As stated above, the vehicle tracking application 50(2) is another of the software applications 50 in the base unit navigation system 40. The vehicle tracking application 50(2) keeps track of the positions of the other vehicles 26(1), 26(2), 26(3) . . . that are traveling on the road network 14. There are several different technologies that the vehicle tracking application 50(2) can use to keep track of the positions of the other vehicles 26. According to one alternative, each of the other vehicles 26 includes positioning system hardware, such as a GPS system, inertial sensors, etc., by which the position of the associated vehicle can be determined. Each of the vehicles equipped in this manner transmits data indicating its position to the emergency vehicle dispatcher system 20. Optionally, each of these vehicles also transmits data about its traveling status including such information as heading, speed, acceleration, turn signal status, etc. These data are transmitted by the other vehicles 26 on a regular basis. The transmission of vehicle position data from the vehicles 26 may be used for purposes in addition to emergency vehicle notification. As an example, the transmission of vehicle position data from the vehicles 26 may be part of a system that provides traffic and route guidance information to the other vehicles 26.

As stated above, there are other ways to determine the positions of the other vehicles 26. For example, the positions of the other vehicles 26 can be determined by using a cellular phone location determining system. (A "cellular phone" is understood to include any wireless telephone technology, including PCS, etc.) The positions of cellular phones can be determined using location determining systems that are part of the cellular phone network. These location determining systems are used to locate cellular phone users who request emergency assistance. By using a cellular phone location determining system, the cellular phones that are located in automobiles can be used to determine the locations of the automobiles. This information is provided to the emergency vehicle dispatcher system 30 where it is used by the vehicle tracking application 50(2) to keep track of the vehicles 26 in the geographic area 12. (According to an alternative, some cellular phones are also equipped with a GPS chip allowing for either GPS or cellular location technology.)

The emergency vehicle dispatcher system 30 may keep track of all the other vehicles 26 on the road network 14 or alternatively, the emergency vehicle dispatcher system 30 may keep track of only some of the other vehicles 26 on the road network 14.

As further stated above, the notification application 50(3) is included among the software applications 50 in the base unit navigation system 40. The notification application 50(3) receives data from the route calculation application 50(1) that indicates the route calculated for the emergency vehicle 22. The notification application 50(3) also receives data indicating the positions of the other vehicles 26 from the vehicle tracking application 50(2). The notification application 50(3) provides an output to the traffic control devices 20. The traffic control devices 20 use the output from the notification application 50(3) to provide the emergency vehicle 22 with the right-of-way along the calculated route, as explained in more detail below. The notification application 50(3) also provides an output to each of the other vehicles 26 that is located close to the calculated route of the emergency vehicle 22, as explained in more detail below.

The emergency vehicle dispatcher system 30 includes an input interface 60. The input interface 60 provides for receiving data that indicates the type of emergency vehicle to send and data indicating the origin and destination for the emergency vehicle. The input interface 60 may receive these data automatically from an emergency call handling system, e.g., a "911-type system." Alternatively, the input interface 60 may provide for receiving these inputs from a human operator, e.g., via a keyboard, etc. After receiving data that indicate the type of emergency vehicle to send and data indicating the origin and destination for the emergency vehicle, the input interface 60 provides these data to the base unit navigation system 40.

The emergency vehicle dispatcher system 30 includes a communications system 62. The communications system 62 includes appropriate equipment (including hardware and software) for exchanging data wirelessly with the emergency vehicle system 32 and each end-user vehicle warning system 34. The communications system 62 uses any suitable technology for sending and receiving data wirelessly in a geographic area, including cellular, PCS, etc. The communications system 62 also includes appropriate equipment for sending data or signals to each traffic signal controller system 36. The communications system 62 is operatively coupled to the base unit navigation system 40. The communications system 62 receives data from the base unit navigation system 40 that indicates the route calculated for the emergency vehicle 22 and sends these data to the emergency vehicle system 32. The communications system 62 also sends the data indicating the emergency vehicle route to each end-user vehicle warning system 34. The communications system 62 also sends data to each traffic signal controller system 36 to operate the stoplights 20.

C. The Emergency Vehicle System

FIG. 2 shows components of the emergency vehicle system 32. The emergency vehicle system 32 is located in the emergency vehicle (22 in FIG. 1). The emergency vehicle system 32 includes a communications system 70 and a remote unit navigation system 76. The communications system 70 in the emergency vehicle system 32 is compatible with the communications system 62 in the emergency vehicle dispatcher system 30 in order to exchange data wirelessly therewith.

The remote unit navigation system 76 in the emergency vehicle system 32 is a counterpart of the base unit navigation system 40 in the emergency vehicle dispatcher system 30. These two systems work together as part of the emergency vehicle safety system 28.

The remote unit navigation system 76 in the emergency vehicle system 32 is a combination of hardware and software components. The hardware components of the remote unit navigation system 76 may include one or more processors, memory, data storage, and so on. The remote unit navigation system 76 also includes a positioning system 80 that determines the position of the emergency vehicle 22 in which it is installed. The positioning system 80 may include sensors 84 or other components that sense the speed, orientation, direction, and so on, of the emergency vehicle 22. The positioning system 80 may also include a GPS system.

The remote unit navigation system 76 also includes a user interface 90. The user interface 90 includes appropriate means 92 for receiving input from an operator in the emergency vehicle 22. These inputting means 92 may include a keyboard, keypad, or other type of input panel, a microphone, as well as other means for accepting operator input, such as voice recognition software, and so on. The user interface 90 also includes appropriate means 96 for providing information back to the operator in the emergency vehicle 22. The information providing means 96 may include a display and a speaker (including speech synthesis hardware and software) through which the operator in the emergency vehicle can be provided with information from the remote unit navigation system 76.

The software components of the remote unit navigation system 76 include one or more applications 98. In the embodiment of FIG. 2, the applications 98 include a route guidance application 98(1), a vehicle positioning application 98(2), and optionally, a map display application 98(3). The navigation programming 98 in the remote unit navigation system 76 may include other applications in addition to these.

The route guidance application 98(1) receives data indicating a route to a destination and then uses the data to develop driving instructions for following the route. In the embodiment of FIG. 2, the data indicating a route are developed by the route calculation application 50(1) in the emergency vehicle dispatcher system 30. The route guidance application 98(1) uses the data to provide instructions and advice to the emergency vehicle driver to travel the route determined by the route calculation application 50(1). The route guidance application 98(1) may include functions that identify locations along the calculated route at which maneuvering instructions may be provided to the emergency vehicle driver. The route guidance application 98(1) may also include functions that formulate the maneuvering instructions for visual output and/or audio output. The route guidance application 98(1) may provide the maneuvering instructions all at once, or alternatively, the route guidance application 98(1) may provide the maneuvering instructions one at a time as the emergency vehicle 22 is traveling. In one embodiment, each maneuvering instruction is provided separately (or in small groups of combined maneuvering instructions) in advance of when the specific maneuver is required to be taken so that the emergency vehicle driver can prepare to make the required maneuver.

The vehicle positioning application 98(2) determines the position of the emergency vehicle 22 relative to the road network. The vehicle positioning application 98(2) uses the output from the positioning system 80 and data indicating the positions of roads to determine on which road segment the emergency vehicle 22 is located and its direction of travel. The vehicle positioning application 98(2) may obtain data indicating the positions of roads from a copy of the geographic database 99 stored locally in the emergency vehicle system 32, or alternatively, the vehicle positioning application 98(2) may receive data indicating the positions of roads from the emergency vehicle dispatcher system 30.

Using the data indicating the position of the emergency vehicle 22 relative to the roads, the route guidance application 98(1) can provide maneuvering instructions at appropriate times and/or locations as the emergency vehicle travels along the calculated route. For example, the maneuver instructions can be provided as the emergency vehicle approaches positions at which maneuvers are required.

The vehicle positioning application 98(2) can also be used to determine whether the emergency vehicle 22 has departed from the calculated route.

The map display application 98(3) is an optional application within the remote unit navigation system 76. The map display application 98(3) is used to show a graphical map of the area around the emergency vehicle to the emergency vehicle operator. The graphical map is shown on the display screen that is included among the output devices 96 of the user interface 90. The data used by the map display application 98(3) to generate the map may be obtained from the on-board geographic database 99, if available, or may be obtained from the emergency vehicle dispatcher system 30. The map display application 98(3) may highlight the route for the emergency vehicle to travel on the displayed map.

The communications system 70 in the emergency vehicle system 32 exchanges data with the counterpart communications system 62 in the emergency vehicle dispatcher system 30. The communications system 70 in the emergency vehicle system 32 is operatively coupled to the remote unit navigation system 76. When data indicating the calculated route for the emergency vehicle to follow are received from the emergency vehicle dispatcher system 30 via the communication system 70, these data are forwarded to the remote unit navigation system 76.

As the emergency vehicle travels along its route, the remote unit navigation system 76 in the emergency vehicle continuously collects data regarding the emergency vehicle traveling status. The emergency vehicle traveling status data include at least the current location of the emergency vehicle (determined using the vehicle positioning application 98(2)), and preferably also include other data that indicate the heading, speed, acceleration, and turn signal status of the emergency vehicle. The emergency vehicle traveling status data may also include other information. The emergency vehicle traveling status data are sent via the communications system 70 to the emergency vehicle dispatcher system 30.

D. The Warning Systems in the End Users' Vehicles

FIG. 2 shows components of one of the end-user vehicle warning systems 34. The end-user vehicle warning system 34 is located in one of the end users' vehicles (26 in FIG. 1). The end-user vehicle warning system 34 allows the end user's vehicle 26 to receive data from the emergency vehicle dispatcher system 30 that indicate the path that the emergency vehicle is expected to follow. The end-user vehicle warning system 34 may also receive data from the emergency vehicle dispatcher system 30 that indicate other aspects of the emergency vehicle traveling status, such as the current location, the heading, speed, acceleration, and turning signal status of the emergency vehicle. The end-user vehicle warning system 34 includes a communications system 102, a user interface 104, and optionally a positioning system 108. The communications system 102 in the end-user vehicle warning system 34 is compatible with the communications system 62 in the emergency vehicle dispatcher system 30 in order to receive data wirelessly therefrom.

The user interface 104 in the end-user vehicle warning system 34 includes a means for providing information to the driver (i.e., the end user) in the vehicle 26. The information providing means may include a speaker and optionally a display through which the end user in the vehicle 26 can be provided with information about the presence of the emergency vehicle in the vicinity of the end user's vehicle 26 and the expected path of travel of the emergency vehicle.

As stated above, the end-user vehicle warning system 34 may include a positioning system 108. The positioning system 108 is optional. If the end-user vehicle warning system 34 has a positioning system 108, it may be similar or identical to the positioning system 80 that is part of the remote unit navigation system 76 located in the emergency vehicle. The end-user positioning system 108 may include sensors or other components that sense the speed, orientation, direction, and so on, of the end user's vehicle 26. The positioning system 108 may also include a GPS system. The positioning system 108 also includes appropriate software to determine the position of the end user's vehicle 26. The position determined by the end user's positioning system may be an absolute position (e.g., latitude and longitude coordinates) or may be a position relative to the road network. The end user's positioning system 108 may use a geographic database for this purpose.

If the end user's vehicle 26 includes a navigation system, the positioning system and user interface of the navigation system may be used as the positioning system and user interface for the end-user vehicle warning system 34. According to this alternative, the functions of the end-user vehicle warning system 34 may be provided as a feature of the navigation system in the end user's vehicle.

E. The Traffic Signal Controller System

FIG. 2 shows components of one of the traffic signal controller systems 36. The traffic signal controller system 36 is associated with one (or more) of the traffic signals (20 in FIG. 1). The traffic signal controller system 36 receives the data from the emergency vehicle dispatcher system 30 that indicate the desired operation of the associated traffic signal 20. In general, the data from the emergency vehicle dispatcher system 30 will cause the traffic signals located along the route calculated for the emergency vehicle to operate to give the emergency vehicle the right-of-way. The traffic signal controller system 36 includes a communications system 120. The communications system 120 is compatible with the communications system 62 in the emergency vehicle dispatcher system 30 in order to receive data or signals therefrom. The communications system 120 may be wireless or may be connected to a land-based communications system in order to receive data from the emergency vehicle dispatcher system 30.

The traffic signal controller system 36 is operatively coupled to one or more traffic signals 20. The data received by the traffic signal controller system 36 from the emergency vehicle dispatcher system 30 are used to control operation of the one or more traffic signals 20 associated therewith.

F. Operation

FIG. 3 is a flow chart that shows operation of the emergency vehicle safety system 28. The operation of the emergency vehicle safety system 28 includes processes performed by the emergency vehicle dispatcher system 30, the traffic signal controller systems 34, the end-user warning systems 34 and the emergency vehicle system 32.

Operation of the emergency vehicle safety system 28 begins with the process in the emergency vehicle dispatcher system 30. The emergency vehicle dispatcher system 30 receives data indicating an origin and destination for the emergency vehicle (Step 200). These data are received by the input interface 60 of the emergency vehicle dispatcher system 30. These data are provided to the base unit navigation system 40. The route calculation application 50(1) in the base unit navigation system 40 uses these data to determine a route for the emergency vehicle to follow to reach the destination (Step 204). The route calculation application 50(1) provides data indicating the route to the emergency vehicle 22. In addition, the route calculation application 50(1) provides data indicating the route of the emergency vehicle to the notification application 50(3) in the base unit navigation system 40. The notification application 50(3) identifies all the controllable traffic signals located along the route calculated for the emergency vehicle (Step 206). The notification application 50(3) also determines the expected time of arrival of the emergency vehicle at each of the controllable traffic signals located along the calculated route. Based upon this information, the notification application 50(3) sends data to each of the traffic signal controller systems 34 associated with the controllable traffic signals located along the calculated route. The data indicate the type of operation for the associated traffic signal to perform as well as the time at which the operation for the associated traffic signal is to take place in order to give the emergency vehicle a right-of-way along the calculated route (Step 208).

Each of the traffic signal controller systems 34 located along the calculated route receives the data from the notification application 50(3) in the emergency vehicle dispatcher system 30 (Step 212). Using these data, each of the traffic signal controller systems 34 operates the one or more traffic signals 20 associated therewith to provide the emergency vehicle with the right-of-way (Step 216).

Referring back to the process in the emergency vehicle dispatcher system 30, the vehicle tracking application 50(2) in the emergency vehicle dispatcher system 30 determines the end users' vehicles 26 that are located along the calculated route of the emergency vehicle (Step 220). The vehicle tracking application 50(2) performs this function by continuously obtaining data indicating the positions of end users' vehicles 26 as they travel along the road network 14 in the geographic area. Alternatively, the vehicle tracking application 50(2) can perform this function while calculating a route for the emergency vehicle by sending a message to each of the end users' vehicles 26 requesting that they send back data indicating their positions along the road network 14 in the geographic area.

After determining which of the end users' vehicles are located along the calculated route of the emergency vehicle, the notification application 50(3) sends data to these end users' vehicles that indicate the path that the emergency vehicle is expected to take (Step 224). The data may include data indicating the entire route of the emergency vehicle or alternatively, the data may include only the data relating to that portion of the route of the emergency vehicle close to each end user's vehicle.

Each end-user vehicle warning system 34 receives the data from the emergency vehicle dispatcher system 30 (Step 228). The end-user vehicle warning system 34 uses the data to provide a warning to the end user (Step 232). The warning is provided to the end user using the user interface (104 in FIG. 2) of the end-user vehicle warning system 34.

Figure 4:
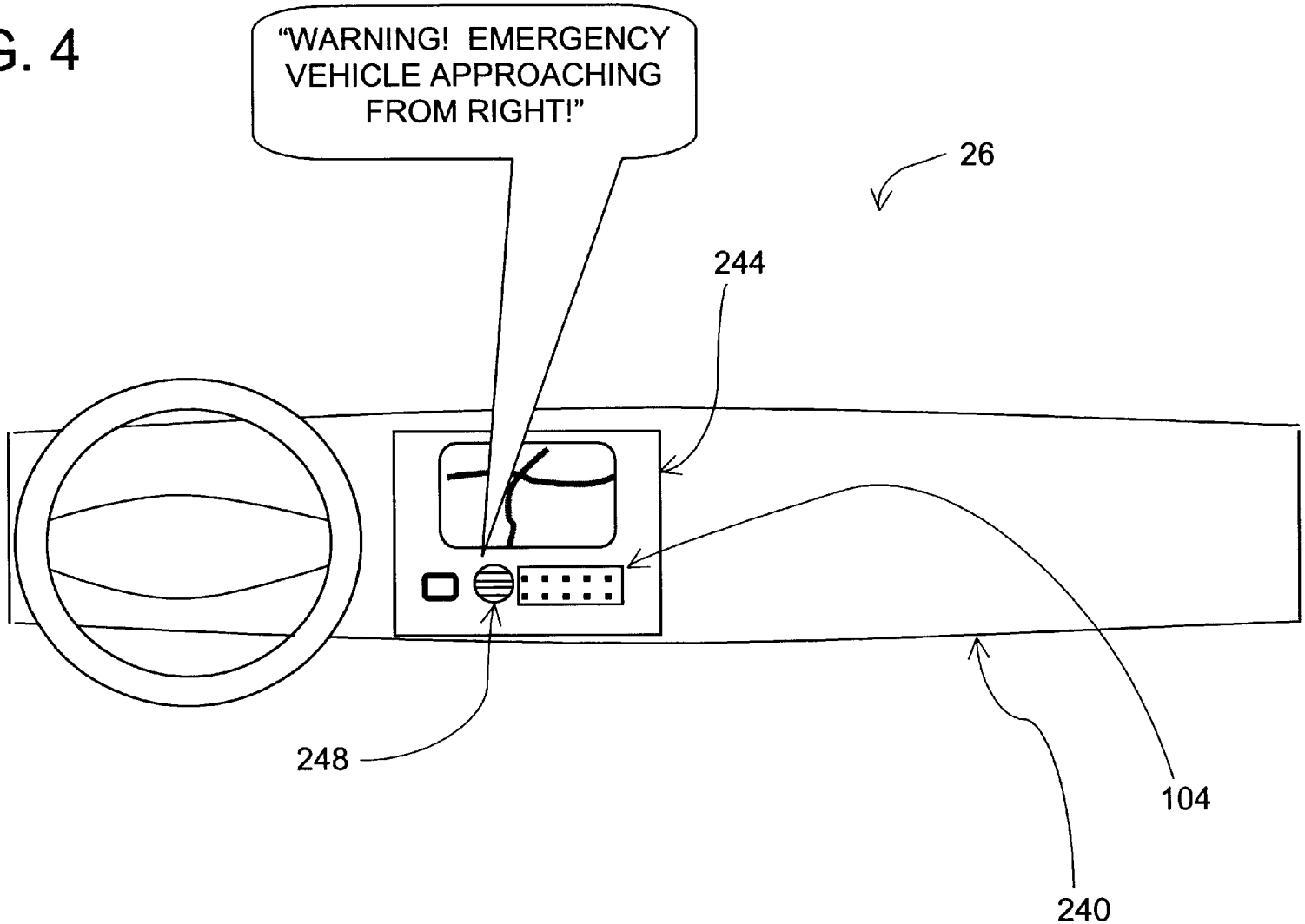
FIG. 4 is an illustration of a dashboard in one of the other vehicles in FIG. 1 and shows a portion of the operation of the emergency vehicle warning system according to the embodiment described in FIGS. 2 and 3.

FIG. 4 illustrates one way that the end user can be provided with a warning by the end-user vehicle warning system 34. FIG. 4 shows a dashboard 240 in one of the end users' vehicles 26. Located in the dashboard is the user interface 104 of the end-user vehicle warning system 34. In this embodiment, the user interface 104 is part of a vehicle navigation system 244 installed in the end user's vehicle 26. The user interface 104 includes a speaker 248. Upon receiving data from the emergency vehicle dispatcher system 30 that indicates the path of the emergency vehicle, the end-user vehicle warning system 34 provides an audible warning using the speaker 248. The wording of the warning may be determined by software in either the emergency vehicle dispatcher system 30 or the end-user vehicle warning system 34.

Figure 5:
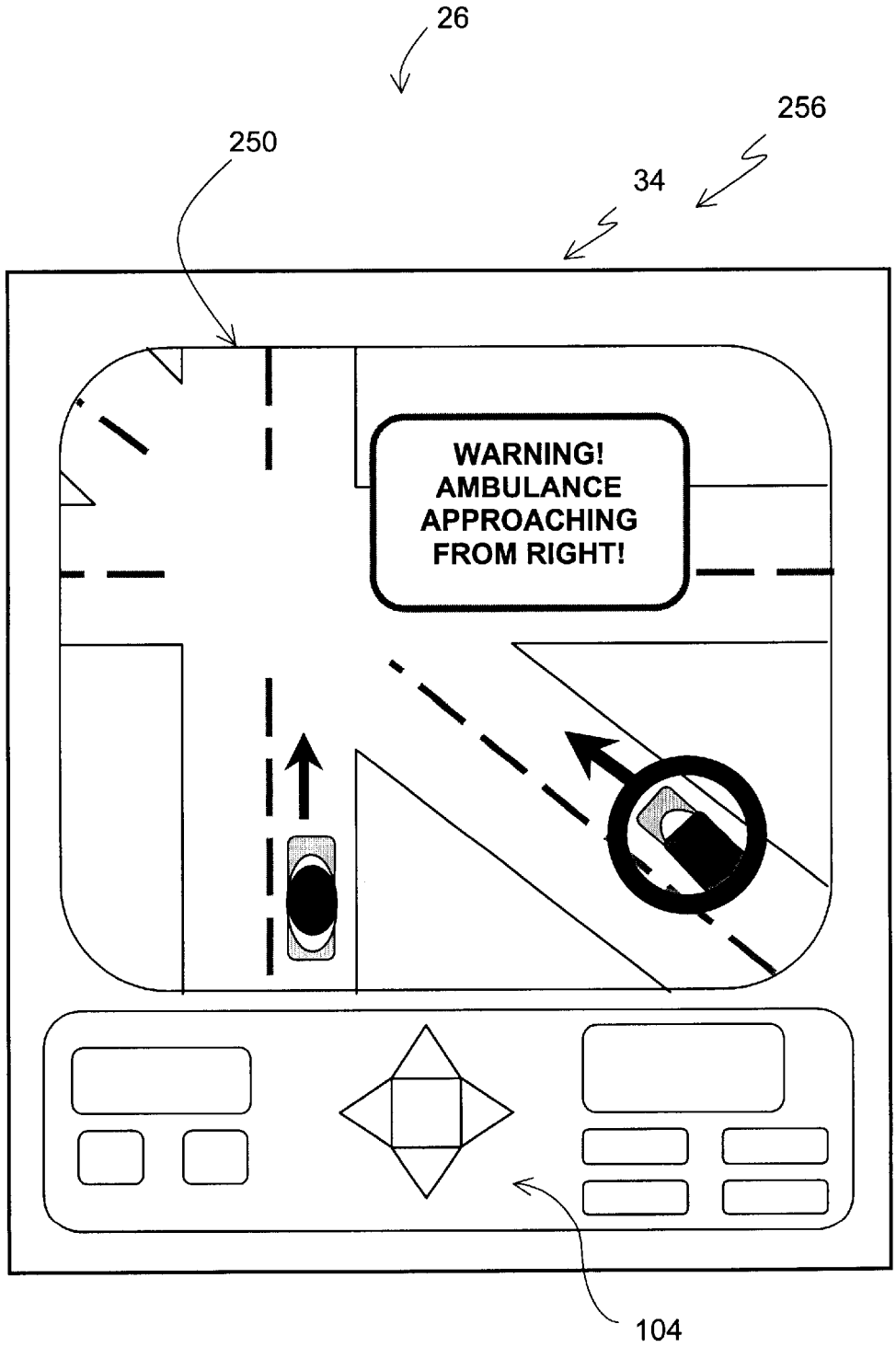
FIG. 5 is an illustration of a navigation system in one of the other vehicles in FIG. 1 and shows a portion of the operation of the emergency vehicle warning system according to the embodiment described in FIGS. 2 and 3.

FIG. 5 illustrates another way that the end user can be provided with a warning by the end-user vehicle warning system 34. FIG. 5 shows a display screen 250. The display screen 250 is part of the user interface 104 of the end-user vehicle warning system 34 in the end user's vehicle 26. The display screen 250 may be part of an in-vehicle navigation system 256 located in the end user's vehicle. Upon receiving data from the emergency vehicle dispatcher system 30 that indicates the path of the emergency vehicle, the end-user vehicle warning system 34 provides a visual warning using the display screen 250. The visual warning may include text, graphics, a map or any combination of text, graphics or a map. The visual warning may be determined by software in either the emergency vehicle dispatcher system 30, the end-user vehicle warning system 34, or the in-vehicle navigation system 256. In the embodiment of FIG. 5, the end user is provided with a clear indication of the path of the emergency vehicle.

Referring again to FIG. 3, it was stated that when the route calculation application 50(1) in the emergency vehicle dispatcher system 30 calculates a route for the emergency vehicle to follow, it sends data indicating the route to the emergency vehicle system 32. In the emergency vehicle 22, the route guidance application 98(1) in the remote unit navigation system 76 of the emergency vehicle system 32 uses the data from the emergency vehicle dispatcher system 20 to provide the operator of the emergency vehicle with driving instructions for following the calculated route to reach the destination. While the emergency vehicle is traveling along the route to the destination, the vehicle positioning application 98(2) in the remote unit navigation system 76 determines the position of the emergency vehicle relative to the calculated route in order to provide maneuvering instructions at appropriate times and locations.

If the vehicle positioning application 98(2) determines that the emergency vehicle has reached the destination, the operation of the emergency warning safety system 28 ends (Steps 264 and 266). However, if at Step 264 the vehicle positioning application 98(2) determines that the emergency vehicle is still on its way to the destination, the operation of the emergency warning safety system 28 continues. The vehicle positioning application 98(2) in the emergency vehicle next determines whether the emergency vehicle has departed from the calculated route (Step 270). If the emergency vehicle has not departed from the calculated route, the operation of the emergency warning system continues by looping back to the step (Step 220) in the process performed by the emergency vehicle dispatcher system 20 in which the other vehicles located along the path of the emergency vehicle are determined. This step (i.e., Step 220), and the steps that follow it, are repeated because it is possible that some of the other vehicles 26 that were not identified as being along the path of the emergency vehicle initially (and therefore not notified initially) may travel into the path of the emergency vehicle at a later time. Also, it is possible that some other vehicles 26 were not being operated (e.g., were not turned on) when the initial notification about the emergency vehicle was sent, and therefore were not notified. Accordingly, if the emergency vehicle has not yet reached its destination (as determined at Step 264) and has not departed from its calculated route (as determined at Step 270), the process in the emergency vehicle dispatcher system 20 is repeated starting with the step in which the other vehicles along the path of the calculated route of the emergency vehicle are identified (Step 220).

The emergency vehicle may depart from traveling along the calculated route for a number of reasons. For example, the emergency vehicle driver may determine that a different route is better. Alternatively, the calculated route may be blocked. According to still another possibility, the emergency vehicle driver may mistakenly take a wrong turn. Regardless of the reason, the vehicle positioning application 98(2) in the emergency vehicle will determine when the emergency vehicle has departed from the calculated route (Step 270). If the emergency vehicle has departed from the calculated route, a new calculated route is needed. Accordingly, if the vehicle positioning application 98(2) in the emergency vehicle determines that the emergency vehicle has departed from the calculated route (at Step 270), the process loops back to the step (i.e., Step 200) in the process performed by the emergency vehicle dispatcher system 20 in which the base system navigation unit 40 receives inputs indicating the origin and destination. When the emergency vehicle has departed from the calculated route, the current position of the emergency vehicle is used as the new origin. The destination remains the same. Then, the process performed by the emergency vehicle dispatcher system 20 continues. Because a new route is calculated, the steps of determining the traffic signals along the new route (Step 206), providing the right-of-way along the new route (Step 208), determining the other vehicles along the new route (Step 220) and notifying the other vehicles along the new route (Step 206) are all performed again.

An advantage associated with having the emergency vehicle dispatching performed from a centralized location is that it facilitates coordinating multiple emergency vehicles moving across a city. Another advantage associated with having the emergency vehicle dispatching performed from a centralized location is that it enables more robust security to be implemented.

II. ALTERNATIVE EMBODIMENTS

A. First Alternative Embodiment

In the embodiment described above, the route for the emergency vehicle to travel is calculated on the emergency vehicle dispatcher system and transmitted to the emergency vehicle. In this first alternative embodiment, the route for the emergency vehicle to travel is calculated by the emergency vehicle system located in the emergency vehicle. Then, data are transmitted from the emergency vehicle system to warning systems located in the other vehicles. In one embodiment, the data are transmitted using a low-powered inter-vehicle communications system. Such systems provide for the exchange of data between vehicles located relatively close together, e.g., within 1 km. In addition, the low-powered communications system can be used to transmit data from the emergency vehicle system to the traffic signal controller systems.

Figure 6:
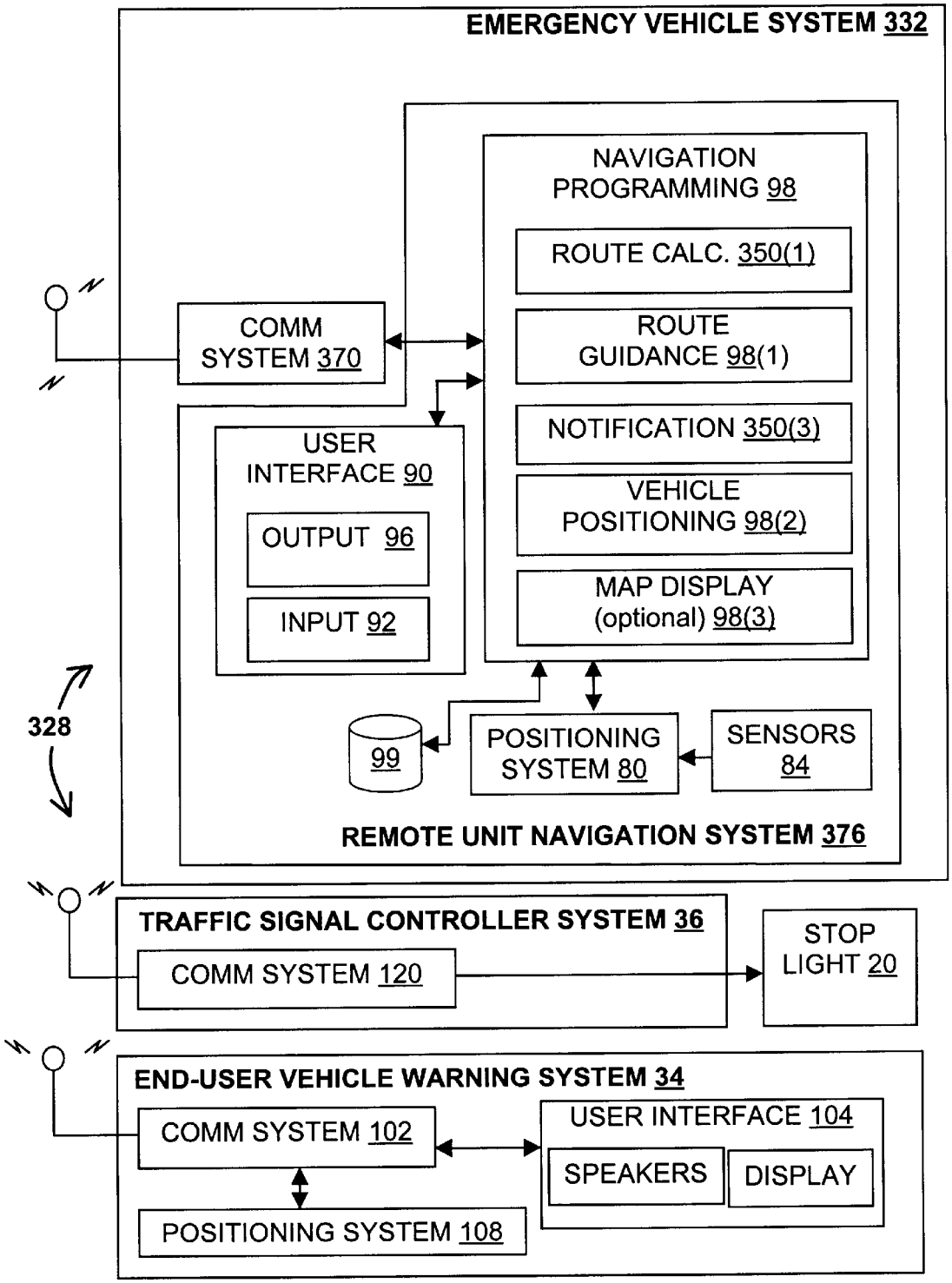
FIG. 6 is a block diagram showing components of another embodiment of the emergency vehicle warning system.

FIG. 6 is a block diagram showing components of this embodiment 328. Some of the components in FIG. 6 are similar or identical to those described in connection with FIG. 2 and like components are labeled with the same numbers. In FIG. 6, an emergency vehicle system 332 includes a remote unit navigation system 376. The remote unit navigation system 376 is similar to the remote unit navigation system 76 described in connection with the first embodiment. In addition to the functions performed by the remote unit navigation system 76 described in connection with the first embodiment, the remote unit navigation system 376 also performs some of the functions of the emergency vehicle dispatcher system 20 in the first embodiment.

The remote unit navigation system 376 receives input indicating an origin and destination for a route for the emergency vehicle to travel. As in the first embodiment, the destination may be the scene of an emergency or alternatively, the destination may be an emergency treatment facility. The origin may be the current location of the emergency vehicle as determined by the vehicle positioning application 98(2) in the remote unit navigation system 376 in the emergency vehicle.

The input indicating the destination may be made manually by an operator in the emergency vehicle. The operator may use the user interface 90 of the emergency vehicle system 332 for this purpose. Alternatively, the input indicating the destination may be received over a wireless communications system from another service, such as a service that handles emergency calls.

Upon receiving inputs indicating an origin and destination, a route calculation application 350(1) located in the remote unit navigation system 376 calculates a route between the origin and destination. The route calculation application 350(1) is similar or identical to the route calculation application 50(1) located in the base unit navigation system 40 in the emergency vehicle dispatcher system 30, described above.

After the route calculation application 350(1) determines a route between the origin and destination, the data indicating the route are used to provide route guidance to the emergency vehicle driver in order to follow the route. In addition, a notification application 350(3) in the remote unit navigation system 376 transmits data indicating the route to the end-user vehicle warning systems 34. The data are transmitted via the communication system 370 in the emergency vehicle system 332. The communications system 370 in the emergency vehicle system 332 is similar to the communications system 70 in the emergency vehicle system 32 in the first embodiment with the exception that it includes the capability of the emergency vehicle dispatcher system 30 of transmitting data to the end-user vehicle warning systems 34, or at least those end-user vehicle warning systems 34 located close to the emergency vehicle 22 or along the path of the emergency vehicle.

The data indicating the emergency vehicle route that are sent from the emergency vehicle system 332 to each of the end users' vehicle warning systems are used in each end-user vehicle warning system 34 to provide a warning to the driver in the vehicle 26 about the presence of the emergency vehicle and the expected route of the emergency vehicle. The warning may be similar or identical to the warnings described above in connection with the first embodiment. In this embodiment, each end-user vehicle warning system 34 may receive data indicating the entire route of the emergency vehicle, determine whether the associated vehicle is close to the expected route of the emergency vehicle and then provide an appropriate warning to the end user/driver of the vehicle. Alternatively, the remote unit navigation system 376 in the emergency vehicle system 332 may perform a vehicle tracking function, similar to the function performed by the vehicle tracking application 50(2) in the first embodiment, and transmit data about the emergency vehicle route (or portion thereof) to only those other vehicles located along the expected path of the emergency vehicle.

The notification application 350(3) in the remote unit navigation system 376 also transmits data to the traffic signal controller systems 36. These data are used by the traffic signal controller systems 36 to operate the traffic signals along the calculated route to give the emergency vehicle the right-of-way.

B. Path Prediction Program Embodiment

In another alternative embodiment, the emergency vehicle warning systems in the end users' vehicles and the system in the emergency vehicle include path prediction programs. These path prediction programs use traveling status data which are exchanged between the emergency vehicle and the other vehicles. As mentioned above, the emergency vehicle is equipped to collect traveling status data. The traveling status data of the emergency vehicle may include (but are not necessarily limited to) the current location, heading, speed, acceleration, turn signal status, and route of the emergency vehicle. Each of the other vehicles located in the area of the emergency vehicle may also be equipped to collect its associated traveling status data. The traveling status data of the emergency vehicle are transmitted to the other vehicles located close to the emergency vehicle. Similarly, the traveling status data of each other vehicle are also transmitted to the emergency vehicle (as well as the other vehicles located close by). Using the traveling status data from the emergency vehicle, the path prediction program in each warning system in each of the other vehicles predicts the path of the emergency vehicle. The path prediction program compares the predicted path of the emergency vehicle with the predicted path of the vehicle in which the warning system is installed. Based on this comparison, a probability of an accident between the emergency vehicle and the vehicle in which the warning system is installed is calculated. If a significant probability of an accident exists, the path prediction program in the end user's vehicle (and the navigation system in the emergency vehicle) provides a warning. The path prediction program may indicate a recommended action to the end user vehicle driver (e.g., pull over, stop, and so on). The path prediction program may also recommend an action to the emergency vehicle driver.

Figure 7:
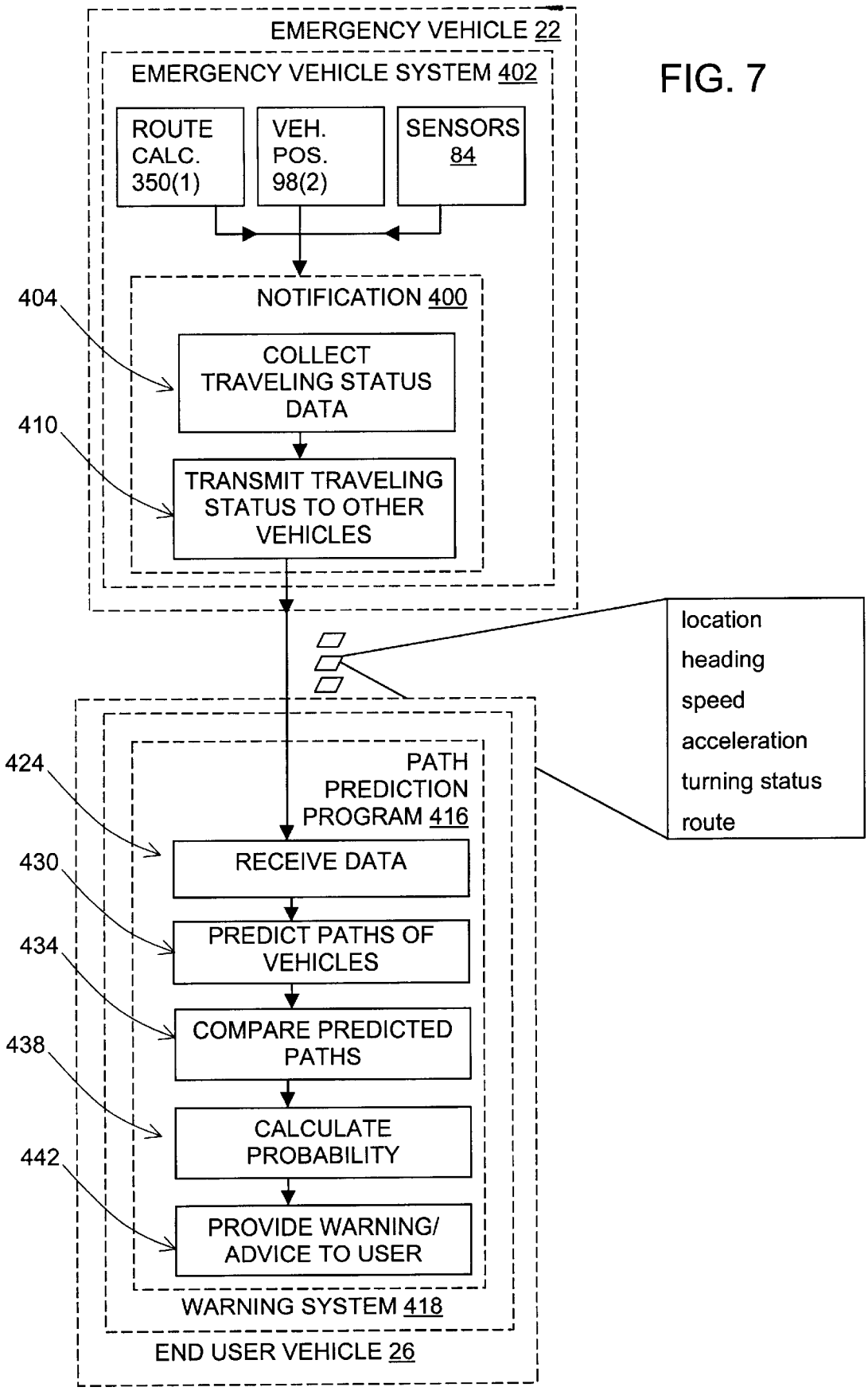
FIG. 7 is a flow chart of an alternative embodiment that includes a path prediction program.

FIG. 7 is a flow chart that shows the steps performed by the notification program in the emergency vehicle and the path prediction program in one of the end user's vehicles. In FIG. 7, a notification program 400 in the emergency vehicle system 402 collects traveling status data (Step 404). The traveling status data include the current location, heading, speed, acceleration, turn signal status, and route of the emergency vehicle. These data may be collected from the route calculation application 98(1), the vehicle positioning application 98(2), and the sensors 84 in the emergency vehicle. These data are then transmitted to other vehicles in the area (Step 410). The data are transmitted using the communications system of the emergency vehicle. In one embodiment, the communications system is the low powered, short-range communications system, described above.

The traveling status data are received by the path prediction program 416 which is part of the end-user vehicle warning system 418 (Step 424). The path prediction program 416 uses the traveling status data from the emergency vehicle, along with similar data collected by the path prediction program for the vehicle in which the path prediction program 416 is installed, to predict the paths of the emergency vehicle and the vehicle in which the path prediction program is installed (Step 430). These predicted paths are compared (Step 434) and a probability of an accident is computed (Step 438). Based on the level of the probability, a warning or other advice is provided by the path predication program 416 to the vehicle driver (Step 442).

The process described in FIG. 7 relates to a notification program in the emergency vehicle that transmits traveling status data which are received and used by a path prediction program in an end user's vehicle to provide the end user/operator with a warning about a possible collision with the emergency vehicle. In order to provide the emergency vehicle operator with a warning about a possible collision, a notification program in each of the end users' vehicles and a path prediction program in the emergency vehicle would perform similar steps.

In addition to exchanging data between the emergency vehicle and the other vehicles located around the emergency vehicle, the emergency vehicle also exchanges data with the traffic signal controllers located along the vehicle path.

C. Other Alternative Embodiments

In the first embodiment described above, the route guidance function was described as being performed by the remote unit navigation system 76 in the emergency vehicle system 32. In an alternative embodiment, the route guidance function can be performed by the base unit navigation system 40 in the emergency vehicle dispatcher system 30. Then, data indicating all the required maneuvers are sent to the emergency vehicle system 32 which explicates them at appropriates times and locations using data indicating the emergency vehicle's position as determined by the vehicle positioning application 98(2) located in the emergency vehicle system 32.

In the first embodiment described above, the notification application 50(3) in the base unit navigation system 40 determines the expected time of arrival of the emergency vehicle at each of the controllable traffic signals located along the calculated route in order to operate the controllable traffic signals at appropriate times to give the emergency vehicle the right-of-way. If the calculated route is relatively short, the notification application 50(3) does not have to determine the expected time of arrival of the emergency vehicle at the controllable traffic signals. Instead, all the controllable traffic signals are operated immediately to provide the emergency vehicle with the right-of-way along the calculated route.

In connection with the first embodiment, it was stated that the emergency vehicle warning systems in the end users' vehicles received data concerning the route of the emergency vehicle, and possibly other information such as the traveling status of the emergency vehicle, from the emergency vehicle dispatcher system. In an alternative embodiment, the emergency vehicle warning systems in the end users' vehicles receive data concerning the route of the emergency vehicle and/or the traveling status of the emergency vehicle from the emergency vehicle's communications system.

In the embodiments described above, the traveling status of the emergency vehicle was provided to other vehicles around the emergency vehicle and to traffic signal controllers. The traveling status of the emergency vehicle may also be provided to the emergency vehicle destination, e.g., the hospital, in order to inform staff about the arrival of the emergency vehicle.

It is intended that the foregoing detailed description be regarded as illustrative rather than limiting and that it is understood that the following claims including all equivalents are intended to define the scope of the invention.

We claim:

1. A method of operation for an emergency vehicle in a geographic region comprising:

calculating a route for the emergency vehicle to travel to a destination in the geographic region, wherein said route is calculated with a navigation system;

determining a position of an end user vehicle traveling within the geographic region;

determining whether the end user vehicle is located along the calculated route of the emergency vehicle;

if the end user vehicle is located along the calculated route of the emergency vehicle, providing information about the emergency vehicle to a driver of the end user vehicle; and if the end user vehicle is not located along the calculated route of the emergency vehicle, providing no information about the emergency vehicle to the driver of the end user vehicle.

2. The method of claim 1 further comprising:

transmitting data about the emergency vehicle to the end user vehicle.

3. The method of claim 2 wherein said data about the emergency vehicle indicates the calculated route of the emergency vehicle.

4. The method of claim 2 wherein said data about the emergency vehicle indicates a current location, heading, speed, acceleration and turn signal status of the emergency vehicle.

5. The method of claim 1 further comprising:

predicting a probability of an accident with the emergency vehicle based on a comparison of a predicted path of the emergency vehicle with a predicted path of the end user vehicle, if said probability is high, said information about the emergency vehicle provided to the driver of the end user vehicle is a warning.

6. The method of claim 1 wherein the information about the emergency vehicle includes an indication of a current location of the emergency vehicle.

7. The method of claim 1 wherein the information about the emergency vehicle includes an indication of a portion of a path of travel of the emergency vehicle.

8. The method of claim 1 wherein the information about the emergency vehicle is a warning of the presence of the emergency vehicle.

9. The method of claim 1 wherein the destination is a location of an emergency.

10. The method of claim 1 wherein the navigation system is located at a central location and data indicating the calculated route are transmitted wirelessly to the emergency vehicle.

11. The method of claim 1 wherein the route is calculated in the emergency vehicle.

12. The method of claim 1 further comprising:

providing a driver of the emergency vehicle with guidance for following the calculated route.

13. The method of claim 1 further comprising:

determining a current position of the emergency vehicle;

comparing the current position to the calculated route;

if the current position is a departure from the calculated route, calculating a new route to the destination;

determining whether the end user vehicle is located along the new route of the emergency vehicle; and if the end user vehicle is located along the new route of the emergency vehicle, providing information about the emergency vehicle to a driver of the end user vehicle.

14. The method of claim 1 further comprising:

determining whether an intersection in the geographic region is along the calculated route; and if the intersection is located along the calculated route of the emergency vehicle, operating traffic signals associated with the intersection to give the emergency vehicle the right-of-way through the intersection.

15. The method of claim 14 further comprising:

transmitting data to traffic signal controller systems associated with said traffic signals, said traffic signal controller systems operate the traffic signals associated with the intersection to give the emergency vehicle the right-of-way through the intersection.

16. The method of claim 14 further comprising:

calculating an expected time of arrival of the emergency vehicle at said intersection, wherein said traffic signals operate at said expected time of arrival to give the emergency vehicle the right-of-way through the intersection.

17. The method of claim 14 further comprising:

determining a current position of the emergency vehicle;

comparing the current position to the calculated route;

if the current position is a departure from the calculated route, calculating a new route to the destination;

determining whether the intersection is along the new route of the emergency vehicle; and if the intersection is located along the new route of the emergency vehicle, operating the traffic signals associated with the intersection to give the emergency vehicle the right-of-way through the intersection.

18. The method of claim 1 further comprising:

transmitting data about the emergency vehicle to other vehicles located along the calculated route.

19. The method of claim 1 wherein the navigation system is located at a central location and data indicating the calculated route are transmitted wirelessly to the emergency vehicle.

20. An emergency vehicle warning system comprising:

a navigation system that calculates a route for the emergency vehicle to travel to a destination in a geographic region;

an end user vehicle warning system installed in an end user vehicle, said end user vehicle warning system receives data regarding the emergency vehicle;

if the end user vehicle is located along the calculated route of the emergency vehicle, said end user vehicle warning system provides a warning to a driver of the end user vehicle; and if the end user vehicle is not located along the calculated route of the emergency vehicle, said end user vehicle warning system provides no warning to a driver of the end user vehicle.

21. The method of claim 20 further comprising:

a traffic signal controller system associated with traffic signals on an intersection in the geographic region, said traffic signal controller system receives data to operate the traffic signals to provide the emergency vehicle a right-of-way through the intersection.

* * * * *